US011814244B1

(12) United States Patent
Bakaysza

(10) Patent No.: US 11,814,244 B1
(45) Date of Patent: Nov. 14, 2023

(54) CORK CONTAINER

(71) Applicant: Andrew Michael Bakaysza, Rohnert Park, CA (US)

(72) Inventor: Andrew Michael Bakaysza, Rohnert Park, CA (US)

( * ) Notice: Subject to any disclaimer, the term of this patent is extended or adjusted under 35 U.S.C. 154(b) by 0 days.

(21) Appl. No.: 17/812,398

(22) Filed: Jul. 13, 2022

Related U.S. Application Data

(60) Provisional application No. 63/224,267, filed on Jul. 21, 2021.

(51) Int. Cl.

| | |
|---|---|
| ***G09F 13/04*** | (2006.01) |
| ***B65F 1/14*** | (2006.01) |
| ***B65F 1/02*** | (2006.01) |
| *G09F 7/18* | (2006.01) |

(52) U.S. Cl.
CPC ..... *B65F 1/141* (2013.01); *B65F 1/02* (2013.01); *G09F 13/04* (2013.01); *B65F 2210/139* (2013.01); *B65F 2210/182* (2013.01); *B65F 2220/128* (2013.01); *B65F 2230/112* (2013.01); *G09F 2007/1852* (2013.01)

(58) Field of Classification Search
CPC ..... G09F 13/04; G09F 2007/1852; G09F 2023/0025; B65F 1/141; B65F 1/02; B65F 2210/139; B65F 2220/128; B65F 2230/112
See application file for complete search history.

(56) References Cited

U.S. PATENT DOCUMENTS

| | | | | | |
|---|---|---|---|---|---|
| 2,411,015 | A | * | 11/1946 | Wolff | B65F 1/02 292/307 R |
| 3,803,738 | A | * | 4/1974 | Weiss | B65F 1/1426 D34/1 |
| 4,827,645 | A | * | 5/1989 | Stamps, Jr. | G09F 15/0043 40/567 |
| D339,707 | S | | 9/1993 | Vernon | |
| D441,223 | S | | 5/2001 | Reeves et al. | |
| D587,018 | S | | 2/2009 | Seckinger | |
| D640,475 | S | | 7/2011 | Seckinger | |
| D672,272 | S | | 12/2012 | Dubow | |
| D688,593 | S | * | 8/2013 | Dubow | D11/157 |
| D700,101 | S | * | 2/2014 | Dubow | D11/157 |
| D705,118 | S | * | 5/2014 | Dubow | D11/157 |

(Continued)

*Primary Examiner* — Gary C Hoge
(74) *Attorney, Agent, or Firm* — Edward S. Sherman, ESQ.

(57) ABSTRACT

A decorative container for collecting used wine corks prior to recycling is formed from at least a front and rear panel that are generally rigid and optionally spaced apart in two parallel planes by sides panels. The side panels may have a plurality of fingers that are received in mating slots in the front and rear panels to form a box with an open upper rim and a closed bottom for receiving the corks. Decorative artwork or photographic images may be printed on the rear surface of a clear front panel. The rear surface of the clear front panel having the decorative artwork or photograph images is covered by a protective laminating layer. Decorative plaques may be attached to the forward face of the front panel via magnets. The magnets may be secured to the front panel by bolts that urge the front and rear panel secure engagement with the side panels. The decorative plaques are sized to fit over the bolts and/or magnet components that would otherwise be visible on the front sheet.

10 Claims, 14 Drawing Sheets

(56) References Cited

U.S. PATENT DOCUMENTS

| | | | | |
|---|---|---|---|---|
| D708,094 | S | 7/2014 | Dubow | |
| D724,355 | S | 3/2015 | Cicerchia | |
| D883,137 | S | 5/2020 | Small | |
| 2002/0166272 | A1* | 11/2002 | Gaymon | G09F 13/04 40/574 |
| 2010/0270199 | A1 | 10/2010 | Nazari | |
| 2011/0139790 | A1* | 6/2011 | Jin | B65F 1/02 220/495.06 |
| 2016/0016730 | A1* | 1/2016 | Supple | B65F 1/1484 220/495.11 |
| 2017/0224863 | A1 | 8/2017 | Dubow | |
| 2019/0084343 | A1* | 3/2019 | Franco | B43L 1/00 |
| 2020/0105164 | A1* | 4/2020 | Coelho | G09F 23/00 |
| 2020/0290800 | A1* | 9/2020 | Davies | B65F 1/06 |
| 2021/0241659 | A1* | 8/2021 | Budzak | G09F 3/08 |

* cited by examiner

FIG. 1B
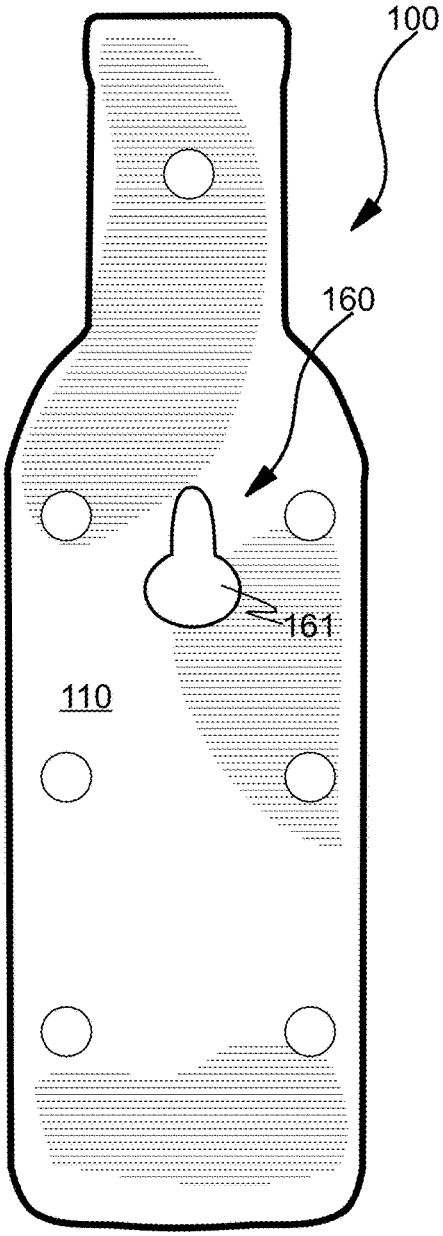
FIG. 1A
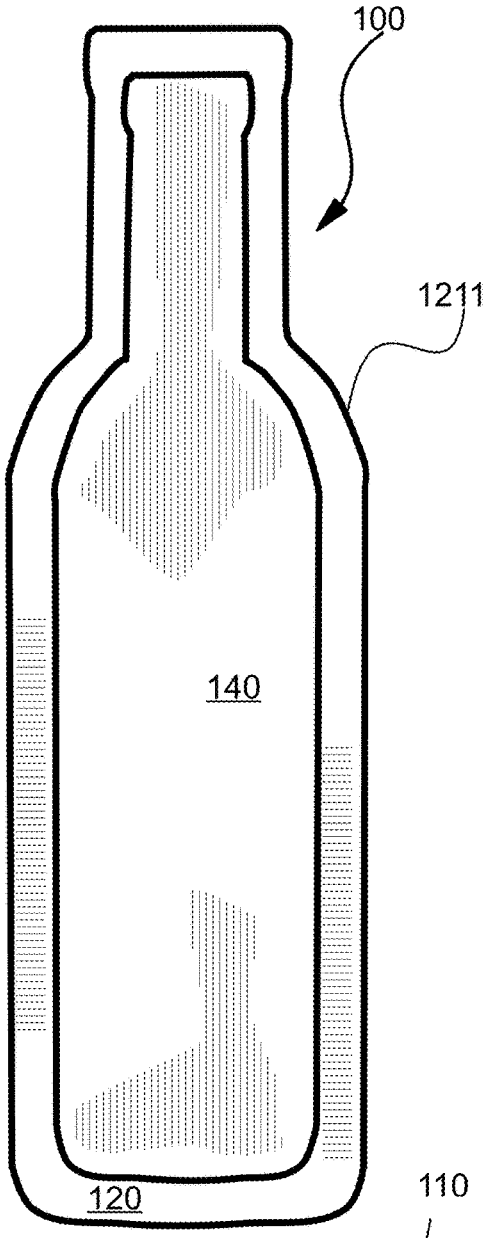
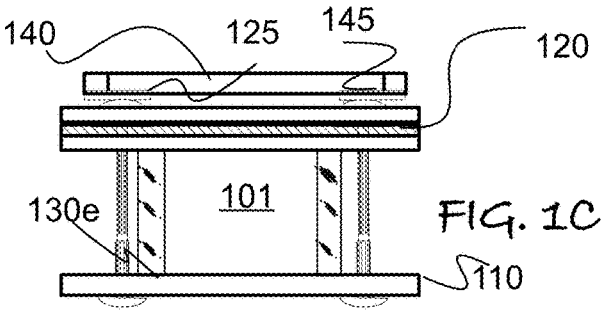
FIG. 1C
FIG. 1D
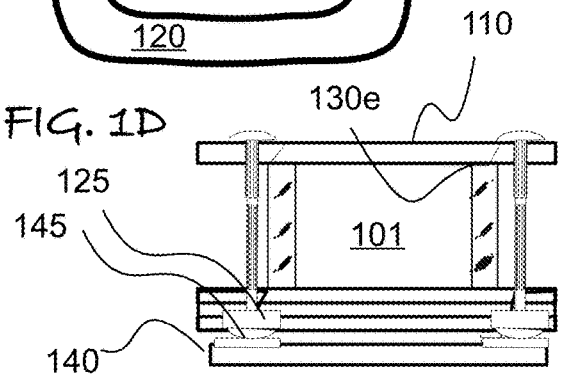

FIG. 2D
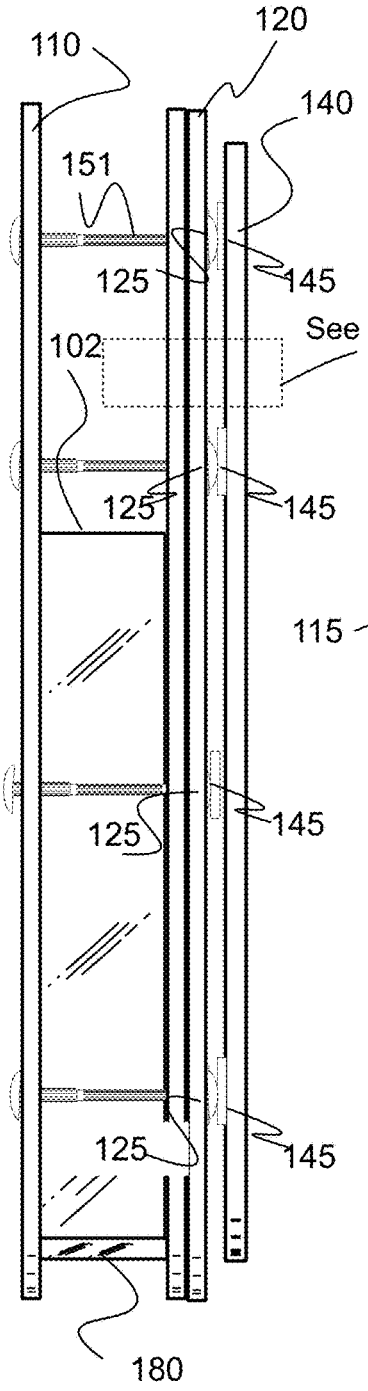
FIG. 2C
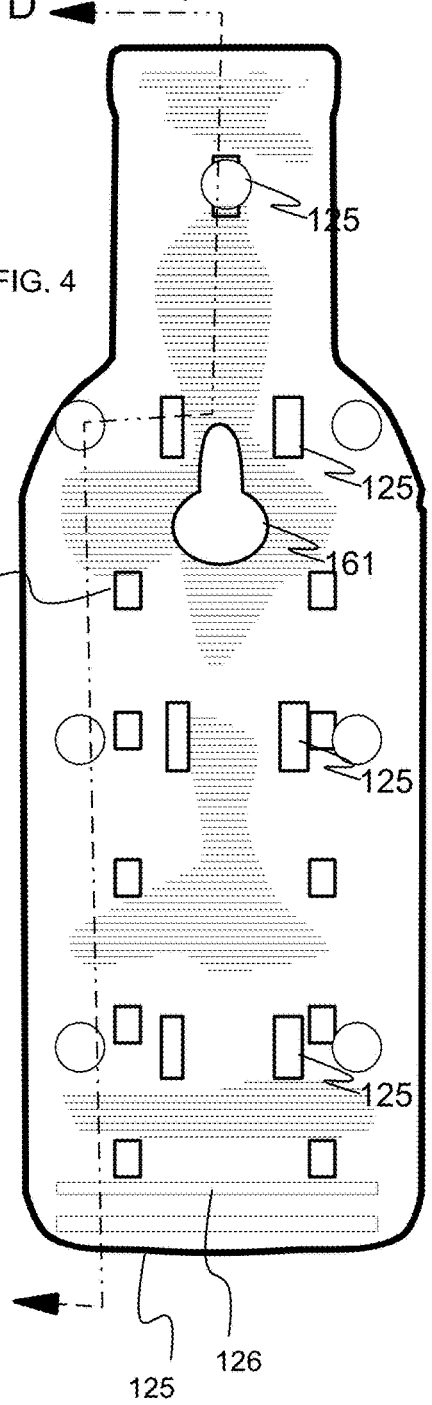
FIG. 2A
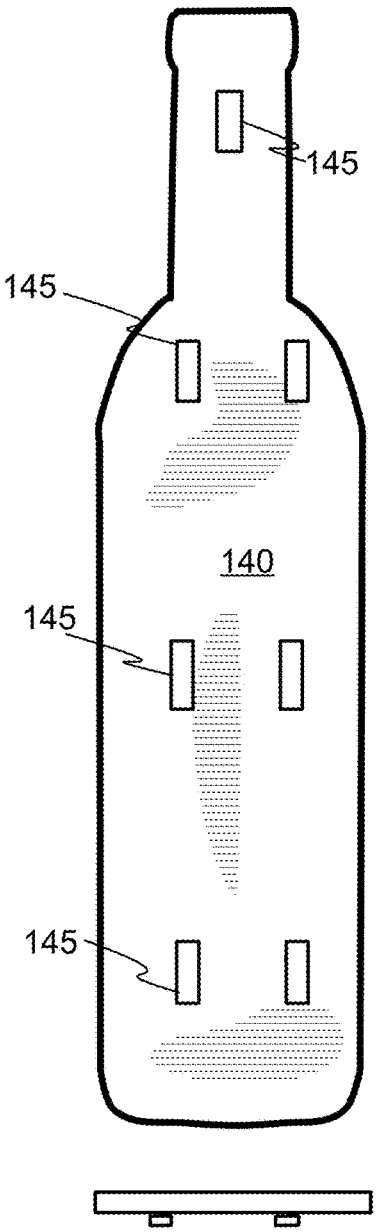
FIG. 2B

B

C
110
161
110
120
120f
120
115
135
135
131
132
115
125
126
125
126
B
C

FIG. 6A
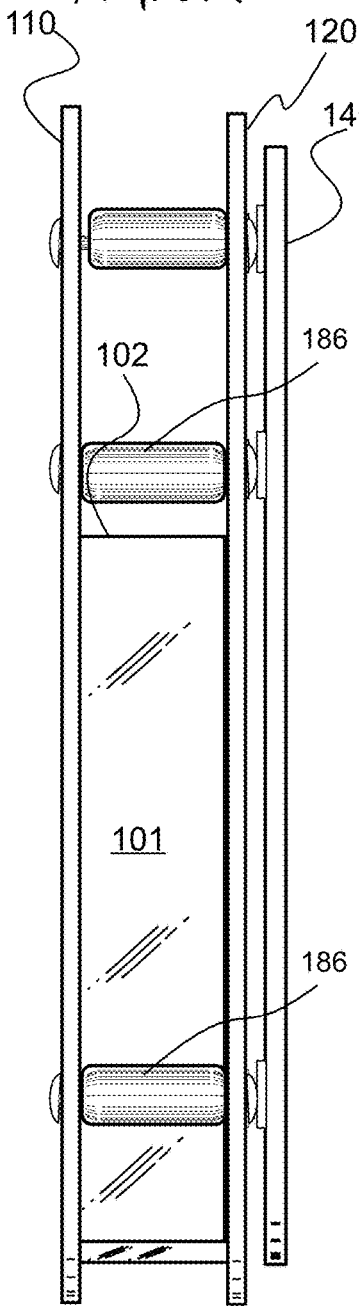
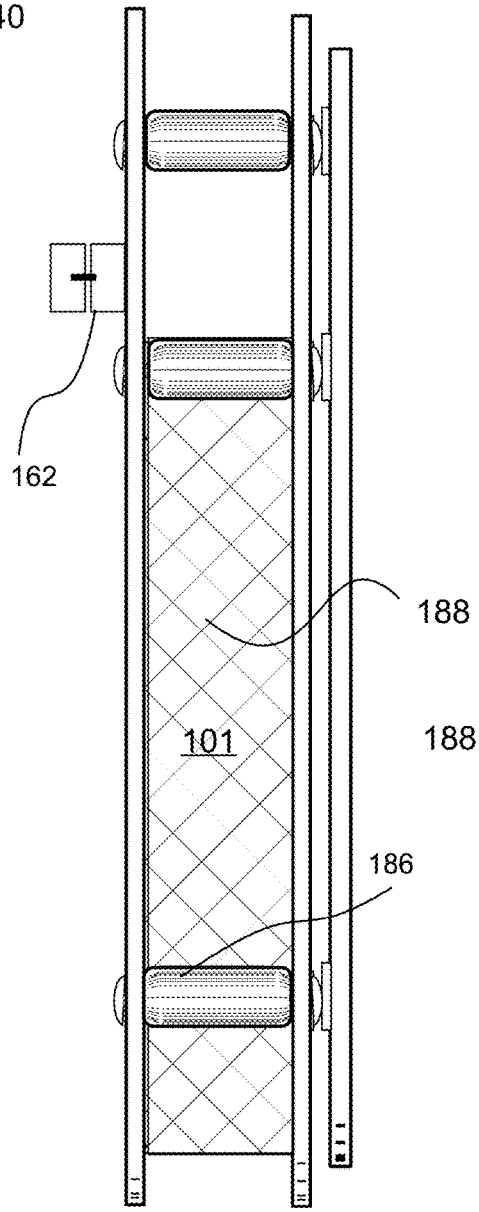
FIG. 6C
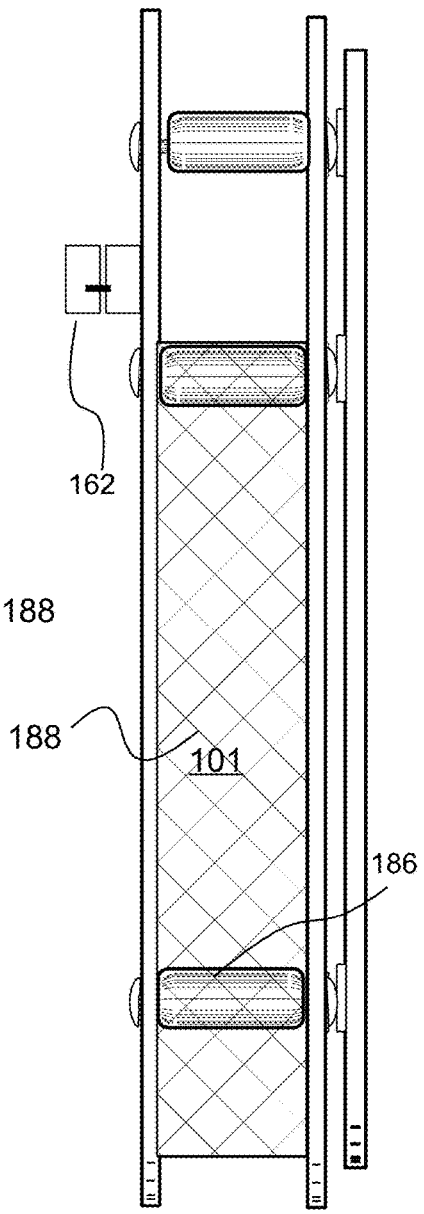
FIG. 6B

FIG. 11A
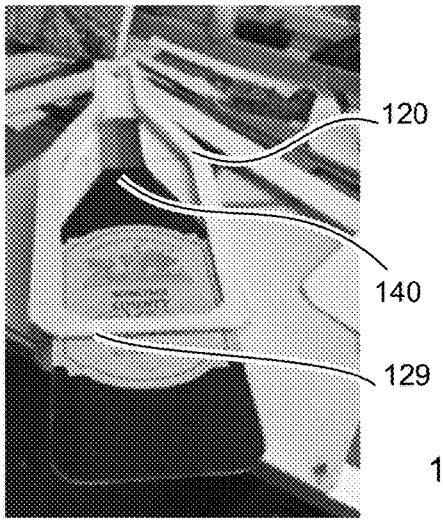
FIG. 11B
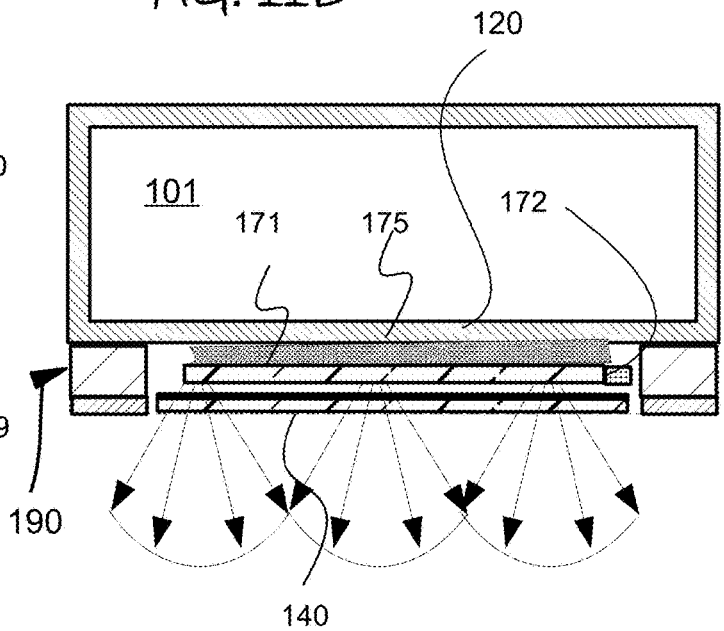
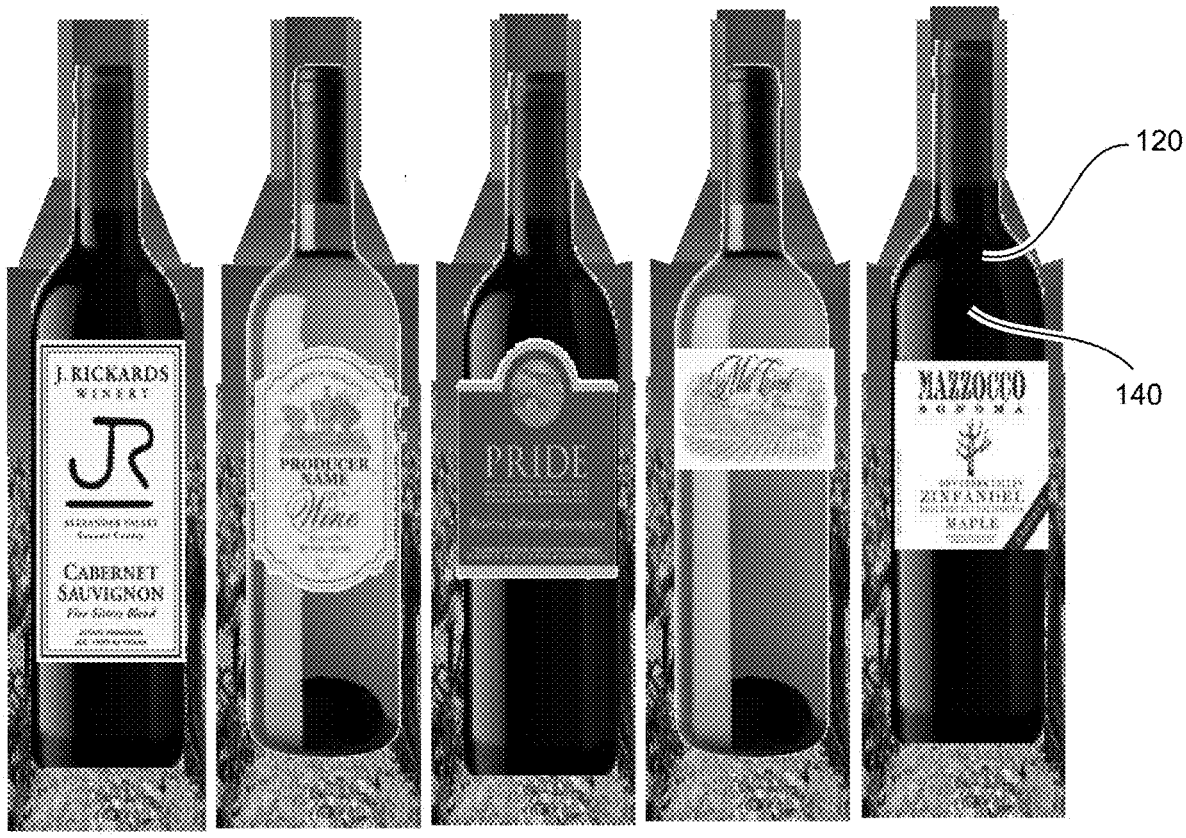
FIG. 11C

CORK CONTAINER

CROSS REFERENCE TO RELATED APPLICATIONS

The present application claims that benefit of priority to the US provisional patent application that was filed on Jul. 7, 2021, having application Ser. No. 63/224,267, and is incorporated herein by reference.

BACKGROUND OF INVENTION

The field of inventions is recycling containers, and more particularly a decorative format for a container to receive corks, bottle caps and can tabs to be recycled.

There are significant environmental advantages of recycling cork.

An artistic display for used wine corks would encourage consumers and high-volume wine consuming establishments, like bars, restaurants and tasting rooms to recycle the corks by collecting them in a decorative container.

It is thus a first objective of the invention to provide a container that is simple to make and assemble.

It is another objective of the invention to provide a simple way to determine when the container is full.

The wall or table mounting of such a container that is at least partially transparent on a side can make it easy to determine if the container is full.

Hence, another objective is to provide several means to wall hang or table mount as well as to empty the full container.

It is also an objective to provide technical means to provide decorative and attractive features that make the container an interesting element of the decor, which is aesthetically pleasing and displays relevant images to patrons or homeowner, to encourage and promote cork recycling.

The above and other objects, effects, features, and advantages of the present innovations will become more apparent from the following description of the embodiments thereof taken in conjunction with the accompanying drawings.

SUMMARY OF INVENTION

In the present innovations, the first object is achieved by providing container comprising a planar back panel, a front panel having at least a portion of a perimeter that is planar and spaced apart from and parallel to the planar back panel, a pair of side panels, each side panel spaced apart from the other side panel and having opposing edges coupled to the planar back panel and planar portions of the front panel to form an enclosed volume with an upper rim in which each spaced apart side panel of the pair is disposed orthogonal to both the planar back panel and the front panel, in which the front panel is a lamination of a clear front sheet having printing on a back surface facing toward the planar back panel and a rear sheet covering the printing on the back surface of the clear front sheet.

The first object may also be achieved by providing a container comprising a planar back panel a front panel having at least a portion of a perimeter that is planar and spaced apart from and parallel to the planar back panel, a pair of side panels, each side panel spaced apart from the other side panel and having opposing edges coupled to the planar back panel and planar portions of the front panel to form an enclosed volume with an upper rim in which each spaced apart side panel of the pair is disposed orthogonal to both the planar back panel and the front panel, a plaque removably coupled to the front panel.

The first object may also be achieved by providing a container comprising a planar back panel, front panel having at least a portion of the perimeter that is planar, a plurality of bottle corks that are generally cylindrically shaped having opposing front and back bases, in which the corks of said plurality are coupled to a perimeter of at least one of the planar back panel and the front panel to couple the planar back panel and the front panel in a spaced apart relationship to define an cavity in which a lateral side and a bottom of the cavity are orthogonal to the planar back panel and the front panel.

Other objects of the innovations may be achieved by provided any such container further comprising a plaque removably coupled to the front panel.

Other objects of the innovations may be achieved by provided any such container in which the plaque is removably coupled in a spaced apart relationship from the front panel by a magnetic means.

Other objects of the innovations may be achieved by provided any such container in which the plaque and the front panel are one of printed and decorated on an internal surface that faces a transparent layer that is one of the front of the plaque and an outward face of the front panel.

Other objects of the innovations may be achieved by provided any such container further comprising a mean to back light at least a portion of the front panel.

Other objects of the innovations may be achieved by provided any such container in which each cork of the plurality covers a central portion of a bolt assembly, the bolt assembly being operative to urge the planar back panel and the front panel against the opposing front and back bases of each cork in which a central portion of the bolt assembly passes through each cork.

Other objects of the innovations may be achieved by provided any such container in which the lateral sides and bottom of the cavity are enclosed by a one of a solid panel and an open structure.

Other objects of the innovations may be achieved by provided any such container in which the lateral sides and bottom of the cavity are enclosed open structure that is one of a mesh and segments of a strap that is wrapped around some of the corks of the plurality of corks.

Other objects of the innovations may be achieved by provided any such container in which the planar front panel is one of transparent and translucent to display the contents of the cavity.

Other objects of the innovations may be achieved by provided any such container in which the front panel has one of a perimeter shaped in the manner of a beverage container and a central portion that projects outward as a half section of a generally cylindrical bottle.

Other objects of the innovations may be achieved by provided any such container in which each cork of the plurality covers a central portion of a bolt assembly, the bolt assembly being operative to urge the planar back panel and the front panel against the opposing front and back bases of each cork in which a central portion of the bolt assembly passes through each cork.

Other objects of the innovations may be achieved by provided any such container in which the lateral sides and bottom of the cavity are enclosed by a one of a solid panel and an open structure.

Other objects of the innovations may be achieved by provided any such container in which the lateral sides and bottom of the cavity are enclosed open structure that is one of a mesh and segments of a strap that is wrapped around some of the corks of the plurality of corks.

Other objects of the innovations may be achieved by provided any such container in which the planar front panel is one of transparent and translucent to display the contents of the cavity.

Other objects of the innovations may be achieved by provided any such container in which the front panel has one of a perimeter shaped in the manner of a beverage container and a central portion that projects outward as a half section of a generally cylindrical bottle.

The above and other objects, effects, features, and advantages of the present innovations will become more apparent from the following description of the embodiments thereof taken in conjunction with the accompanying drawings.

BRIEF DESCRIPTION OF DRAWINGS

FIG. 1A is a schematic front elevation view of a first embodiment of the cork container, whereas FIG. 1B is a rear elevation view thereof and FIG. 1C is a bottom plan view of thereof and FIG. 1D is a partial cut-way of a top plan view thereof.

FIG. 2A is a rear elevation view of the plaque in FIGS. 1A, C and D, whereas and FIG. 2B is a top plan view thereof. FIG. 2C is a front elevation view of the front panel of FIG. 1A-D prior to assembly to the rear panel. FIG. 2D is a cross-sectional elevation of the front panel at section line D-D in FIG. 2C.

FIG. 3A-F illustrate in various elevation views the front, rear, and side panels of the first embodiment prior to assembly, in which FIG. 3A is an elevation view of the front face of the front panel, FIGS. 3B and 3D are front elevation view of the side panels and FIG. 3F is a front elevation view of the rear panel. FIGS. 3B and 3D are sectional elevation views through the front and rear panels at section lines B-B and D-D, respectively.

FIG. 6A-C are side elevation views of alternative embodiments.

FIG. 8A is a perspective view of another embodiment whereas

FIG. 10A-10D illustrate another alternative embodiment of the innovations in which FIG. 10A is an exploded perspective exterior view, FIG. 10B is a schematic side elevation view thereof and FIGS. 10C and 10D are sections view at sections lines C/D in FIG. 10B illustrating alternative lighting means.

FIG. 11A is a schematic exterior perspective view illustrating a step in inserting a removable front panel and FIG. 11B is a section view at sections lines C/D in FIG. 10B illustrating another alternative lighting means. FIG. 10C are schematic front elevation views illustrating alternative appearances with different plaques.

DETAILED DESCRIPTION

Figures 3A, 3B, 3C, 3D, 3E, 3F:
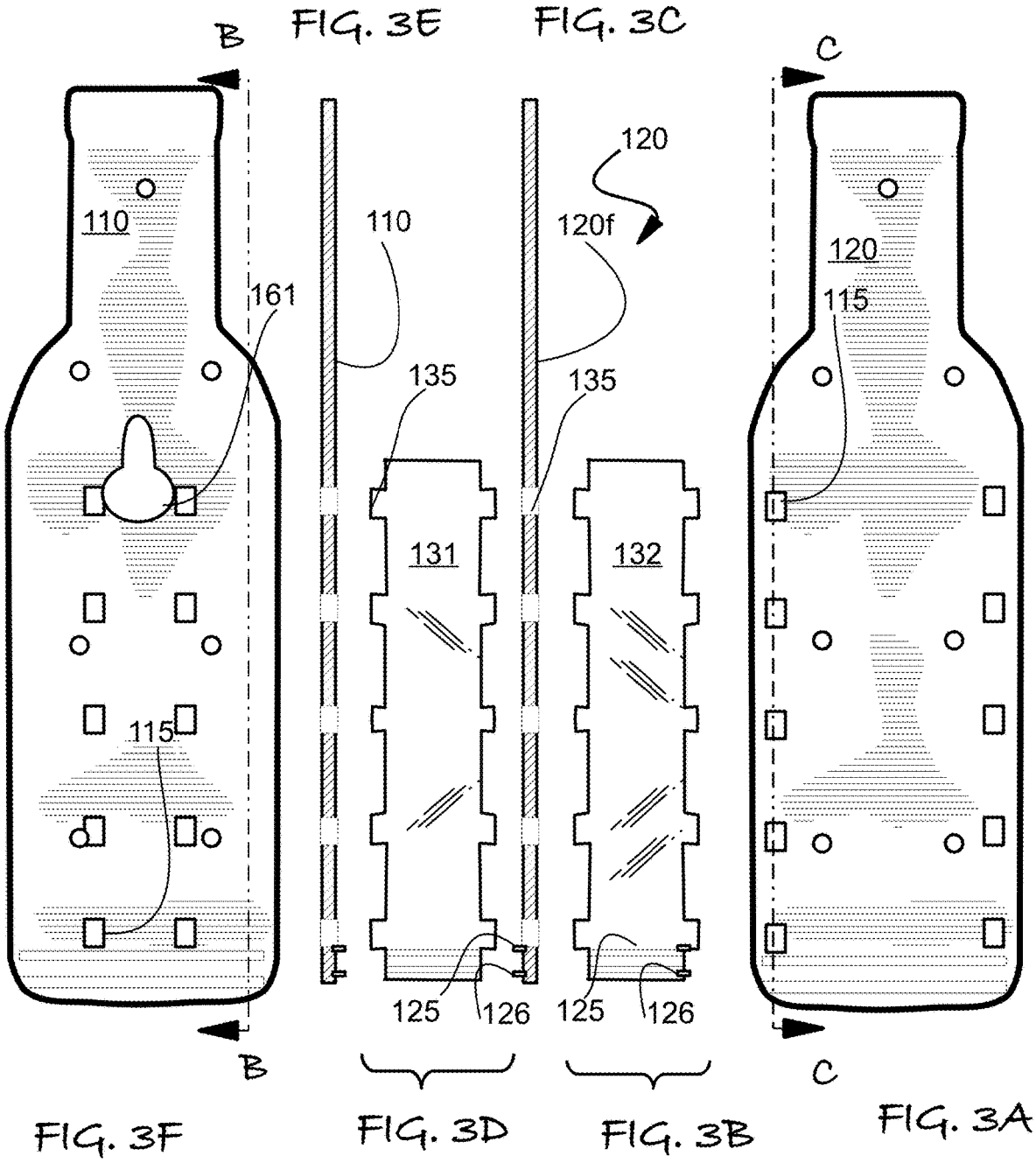

Referring to FIGS. 1A through 14, wherein like reference numerals refer to like components in the various views, there is illustrated therein a new and improved cork container, generally denominated 100 herein.

In accordance with an embodiment of the present innovations the cork container 100 may comprise a planar back panel 110 and a front panel 120 having at least a portion of the perimeter 1211 that is planar and spaced apart from and parallel to the planar back panel, a pair of spacer side panels 131 and 132 that are spaced apart with each of the pair having the opposing edges 130*e* coupled to the planar back panel 110 and planar portions of the front panel 120 to form an enclosed volume or cavity 101 with an upper rim 102 in which each spacer side panels 131 and 132 of the pair is disposed orthogonal to both the planar back panel 110 and the front panel 120. The planar front panel 120 is preferably a lamination of a clear front sheet 121 having printing 122 on a back surface 121*b* facing toward the planar back panel 110 and a rear sheet 123 covering the printing 122 on the back surface of the clear front sheet.

The front 120 and planar back panel 110 are generally rigid and optionally spaced apart in two parallel planes by sides panels 131 and 132, but in other embodiment the decorative combinations of the front face 120, plaques and/or lighting means can be combined in alternative ways with different ways to provided an open top and closed bottom vessel with an interior cavity 101 for receiving and storing corks.

In the embodiments of FIG. 1A to 6A the front 120 and rear panel 110 are attached to the spacer panels 131 and 132 via the plurality of fingers 135 on the edges of each spacer panels that are received in mating slots 115 in the rear 110 and front panel 120. The height, width, and number of such of such finger can be varied to accommodate different size and weight front panels 120 and rear panels 110.

In more preferred aspects of this embodiment, the side panel 131 and 132 are rigid and/or clear or translucent. Thus, contents of corks with the container 100 are at least partially visible through the side panel 131 and 132, or the equivalents thereof in other embodiments.

The planar back panel 110 and/or front panel 120 may have essentially the same shape. They are intended as non-limiting examples that accomplish the purpose of achieving another object of providing an artistic display while providing the functionality of a cork receptacle. The versatile nature of the various embodiments to create various customizable appearances, sizes and shapes increases the desirability to mount the container 100 in prominent locations so users will remember to recycle corks by depositing them therein.

As non-limiting examples, the shapes of at least the front 120, and optionally the back 110 panel can be in the form of a beverage container, such as wine bottles, champagne bottles, corks, casks or barrels, wine glasses, bottle for sparkling wine, cognac, rum, port, whiskey, scotch, beer, cans for beer and the like.

FIG. 6A-C illustrate the use of cork spacers 186 to cover the bolt assembly 151 that secure the front panel 120 to the back panel 120, which can be used with or replace the spacer panels 131 and 132.

FIGS. 6B and 6C illustrate the replacement of the cork storage portion that is cavity 101 otherwise bounded by spacer panels 131 and 132 with a mesh 188 that is pliable and optionally wrapped around the corks 186 covering the bolt assemblies (FIG. 6C) or a pliable mesh or substantially solid or pliable grate or mesh 188 placed between the opposing corks 186 (FIG. 6B).

Figure 7B:
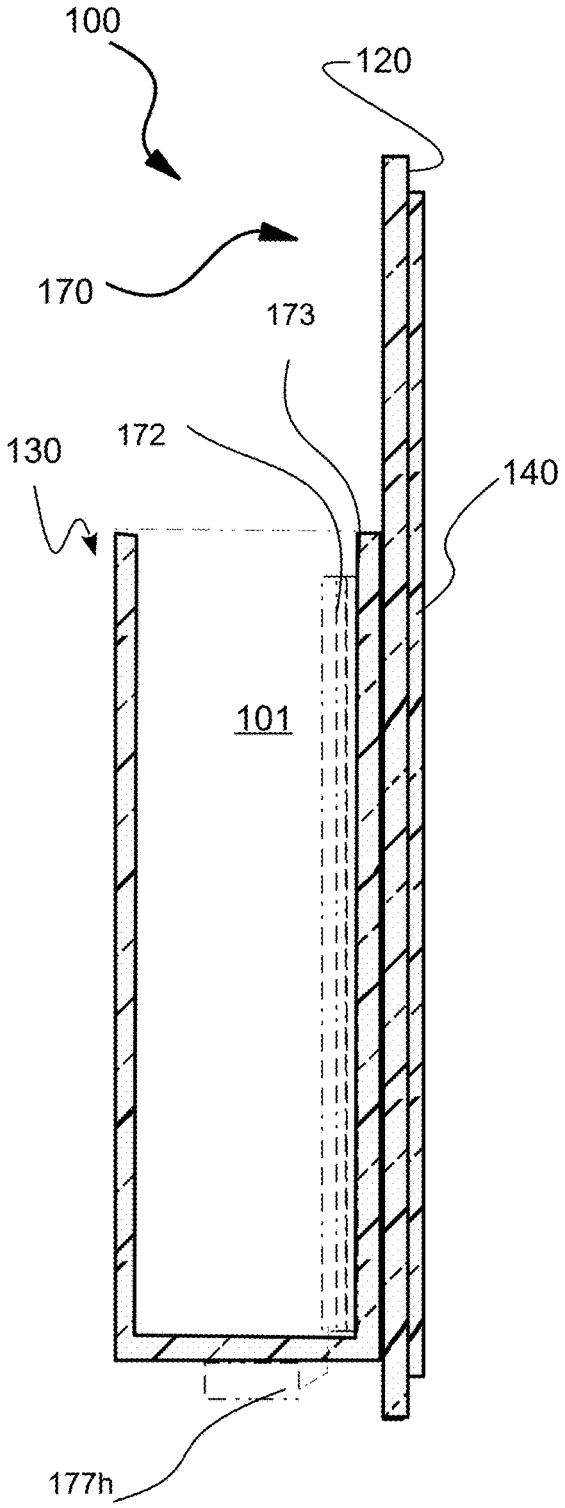
FIG. 7A is a real elevation view of another embodiment and FIG. 7B is a cross-sectional elevation view thereof taken at section line B-B in FIG. 7A.
Figure 7A:
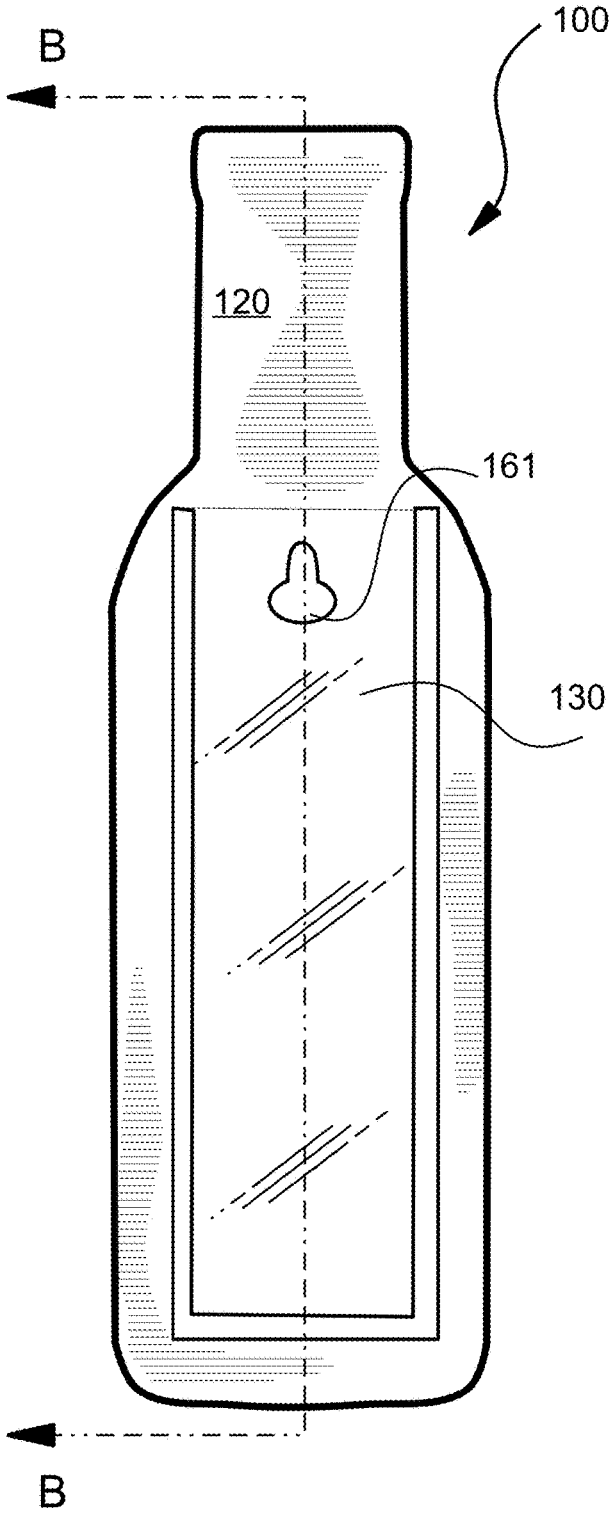

FIG. 7A-B illustrate an alternative embodiment of the container 100 having a cavity 101 within a preformed container 130. In this embodiment, the back panel 110, side panels 131 and 132 are replaced by the sides of any molded container or vessel 130 with an open top at the upper perimeter or rim 136 to the cavity 101. The front panel 120 can be attached or laminated to the front of the pre-formed or molded container. Various plaques 140 can be attached to the front of the preformed container, front panel 120 and its equivalents to complete the decorative display aspect of these alternative embodiments. The various lighting means 170, front panels and plaques 140 described with respect to the following embodiments in FIG. 7A-12C can be deployed with container 130 or container 110, as described in previous embodiments, and the equivalents thereof.

FIG. 7A-B also illustrate a first embodiment of the container 100 or 130 that deploys a lighted means 170 configured to illuminate at least one of a face or sides of the side panels 131 and 132, front panel 120, and the plaque 140. In the embodiment of FIG. 7A-B. The lighting means 170 is optionally a strip of LED lights 172 disposed between the container 130 or in cavity 101 to illuminate one or both of the plaque 140 and front panel 120 through either the planar or front face or via the edges, as will be illustrated in further details in additional embodiments in FIG. 8A-12C.

The lighting means 170 may deploy bulb or emitters of lights, such as LED lighting strip 172, means for power generation and or storage, such as a battery or photocell or other recharger or a wired power supply and/or switch 177. A light diffusing sheet, film, or diffusing coating 173 may be deployed in front of the LED strip 172 or equivalent. Other embodiments use edge lighting panel or strips 171.

Figure 8B:
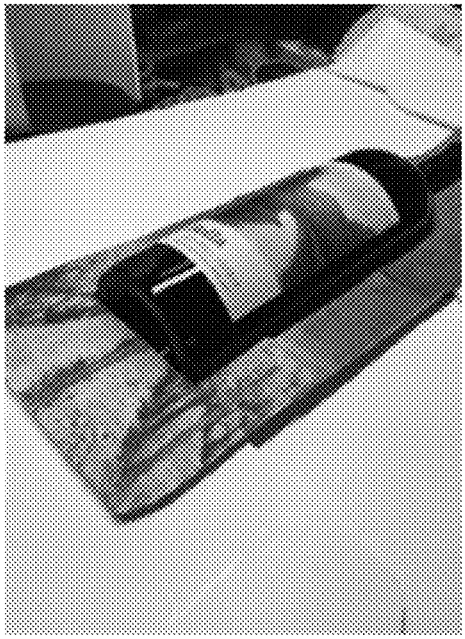
FIG. 8B is a side elevation view thereof.
Figure 8A:
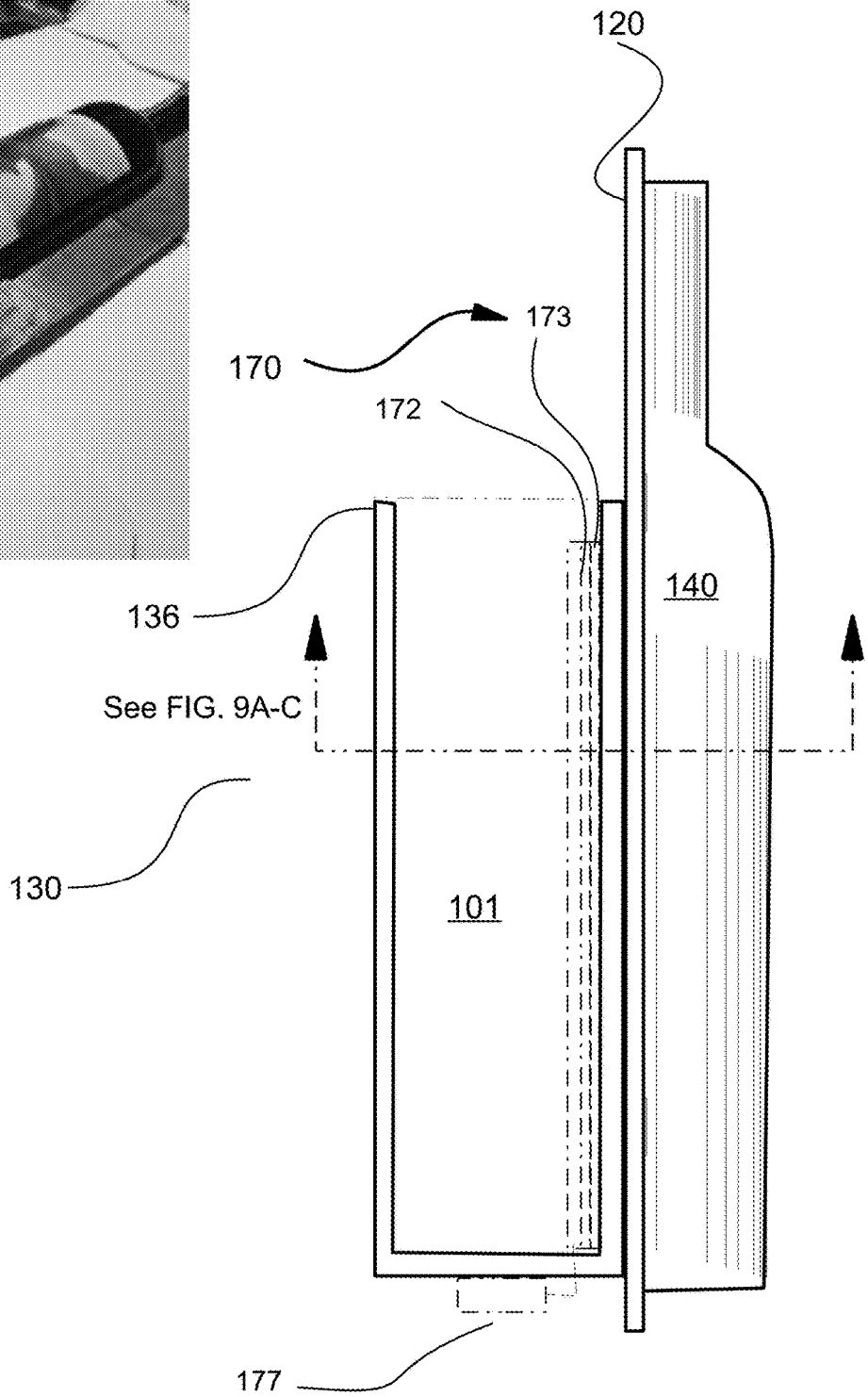
Figure 9C:
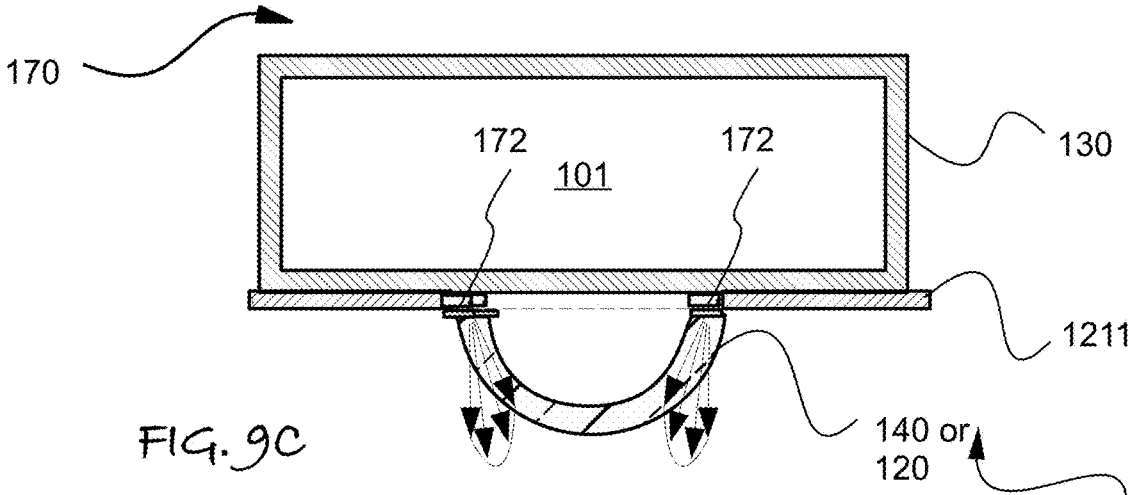
FIG. 9A-C schematically illustrate in plan cross-sectional alternative lighting means that may be deployed with the embodiments of FIG. 8A-B.
Figure 9B:
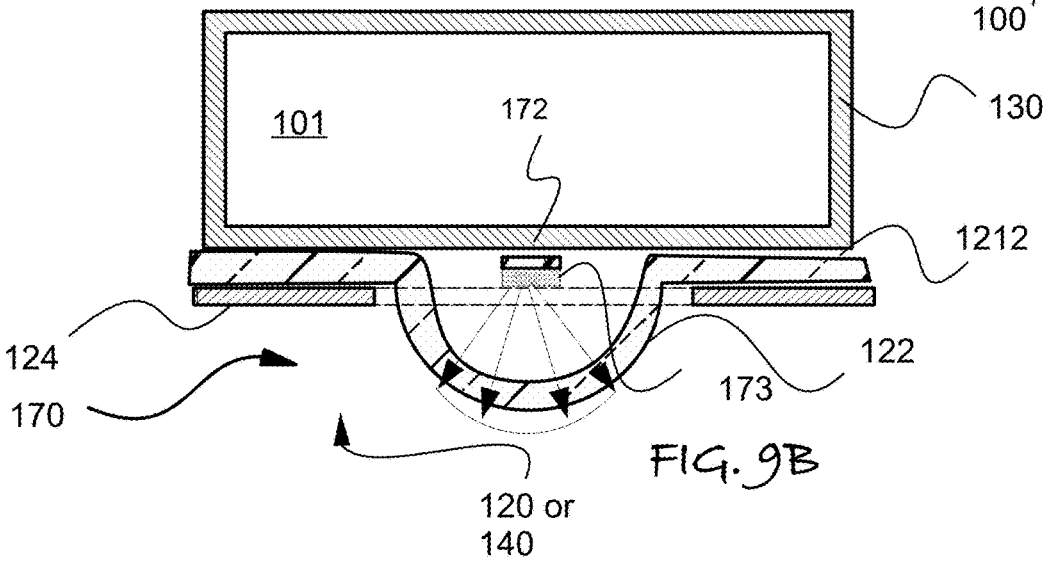
Figure 9A:
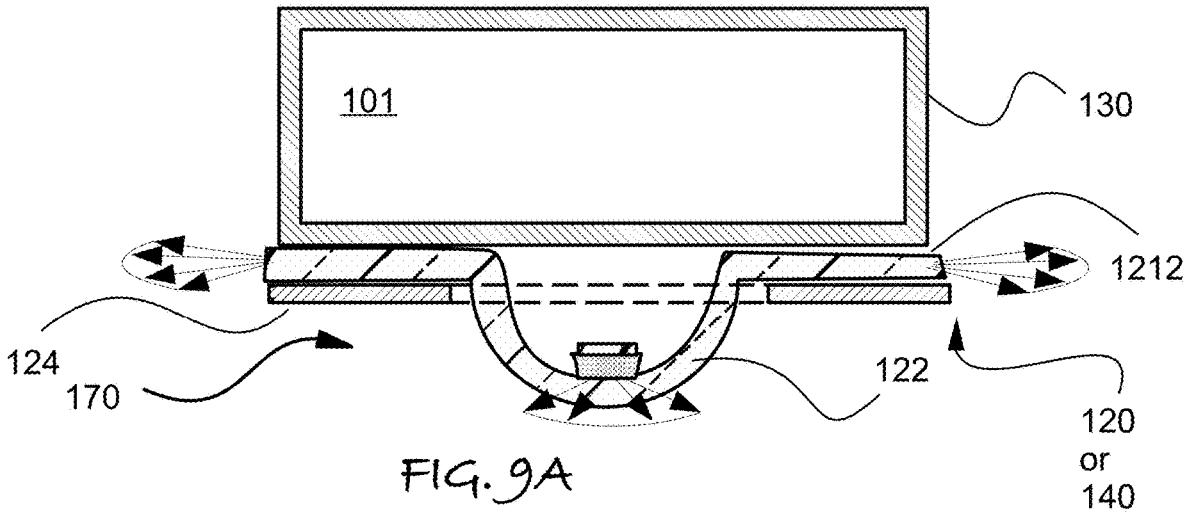

In the embodiments of FIG. 8A-B, among others, the container 100 may deploy the front panel 120 and/or plaque 140 of which one or both are wine bottle shaped and optionally may have a clear or translucent green or red appearance. As in other embodiments, the front panel 120 may provide a decorative framing picture or design, and the changeable portion, such as a plaque 140 appears to be placed in front of it; in this embodiment appearing to pop out of the scene on the front panel 120 like a wine bottle floating in air FIG. 9A-C illustrate the optional lighting means 170 that may be deployed in embodiments with a plaque 140 or front panel 120 having a non-planar portion 122, as well as other portions 1211 that are substantially planar. The non-planar portion 122 may be formed by thermoforming plastic sheet to resemble a half section of a beverage storage bottle, or any other 3-dimension shape, or part thereof. As a non-limiting example, the plaque 140 or the front panel 120 can have a planar portion, 1212 and half or partial cylinder shape portion 122 adjacent or within the planar portion 1212. In FIG. 9A the plaque 120 or 140 has a half cylinder shape to give the appearance of a bottle being embedded in the container 100 or floating in from of the scenery printed on the front panel 120. Further, the lighting means 170 is disposed adjacent and behind the non-planar portion 122 of the panel 120 so diffused light is emitted from the front of the non-planar portion 1212 while other light emitted by the LED strip 172 undergoes total internal reflection within the transparent portion of the front panel 120 to exit at the opposing sides thereof.

In FIG. 9B-C the planar portion of 1211 or the front panel 120 with the curved center portion 122 may have fixed or replaceable coverings 124 for the planar portion, which can be replaced with the same means or other attributed to plaques 140.

In FIG. 9B, the lighting means 170 is disposed adjacent and behind the non-planar portion 122 so diffused light is emitted from the front of the non-planar portion while other light emitted by the LED strip 172 undergoes total internal reflection within the transparent portion of the front panel 120 to exit at the opposing sides thereof.

In FIG. 9C, the lighting means 170 is illustrated two LED strips 172, each edge lighting the curved plaque 140 from opposing edges. The front panel 120 may surround the plaque 140, with the region of the front panel 120 from the perimeter 1211 being visible and appearing behind the plaque 140.

In some embodiment, plaque(s) 140 that are smaller than the front panel 120 are removably attached thereto by various means. A preferred means to attach such plaques 140 is via magnets 145 glued to the back of the plaque 140. Magnets 145 disposed proximal to the clear front panel 120 may be deployed to magnetically secure one or more decorative plaques 140 on a forward-facing surface of the front panel 120 via attraction to the corresponding magnets 145 on the back of the plaque 140. Such magnets 145 are preferably in planar portions to align complimentary design or decorative aspects of the decoration or printing on the front panel 120 with the plaque 140. Alternative means for attachment of the plaques, such as a slot/hook fastener, loop and hook fastener, such as Velcro™ brand, or sliding into a track on the sides or top and bottom of the plaque 140 and the complimentary feature of the front face 120.

Preferably, a plaque 140 may be constructed as a lamination of a clear front sheet 141 having printing 142 on a back surface 141*b* and a rear sheet 143 covering the printing 142 on the back surface of the clear front sheet. Magnets 145 may be glued to the rear sheet 143, which is optionally heavy paper, woven, or non-woven fabric or the like as a protective backing.

In some embodiment there is a means 150 to urge the planar front panel 120 and back panel 110 against the spacer or side panels 131 and 132 and/or maintain the mutual connections thereof. In some embodiments such means 150 is a bolt assembly 151 which include bolts that connect into threaded rivets that penetrate holes in the back panel 110 and receive bolts with the head contacting the front panel 120. When the bolt heads are ferromagnetic, they may replace the magnets 145. Alternatively, the magnets 145 may have a hole to receive bolt shaft, to position the magnet 145 under the bolt head.

Alternatives means 150 to urge or connect the rear panel 110 and front panel 120 in secure placement and attachment, preferably orthogonal to side panels 131 and 132 include adhesive, ultrasonic welding, and wine corks adhered to the front 120 and rear panel 120, as well as passing the threaded inserts and bolts through a bore in the wine corks, as illustrated in FIGS. 6B and 6C.

Additional embodiment may also provide a means 160 to hang from a wall or mount upright on a horizontal surface, such as a hanging hole 161 or the swivel connector 162 with a hole adjacent the rotation axis of the fixed member that attaches to the wall. The hole is intended to receive a nail or screw to fix the swivel connector 162 to the wall or another vertical surface.

In any of the various embodiment the container 100 or 130 the front face 120*f* may contains or forms a substrate for printing or applying pre-printed decals, wine labels and/or bottle foils.

Figures 4A, 4B:
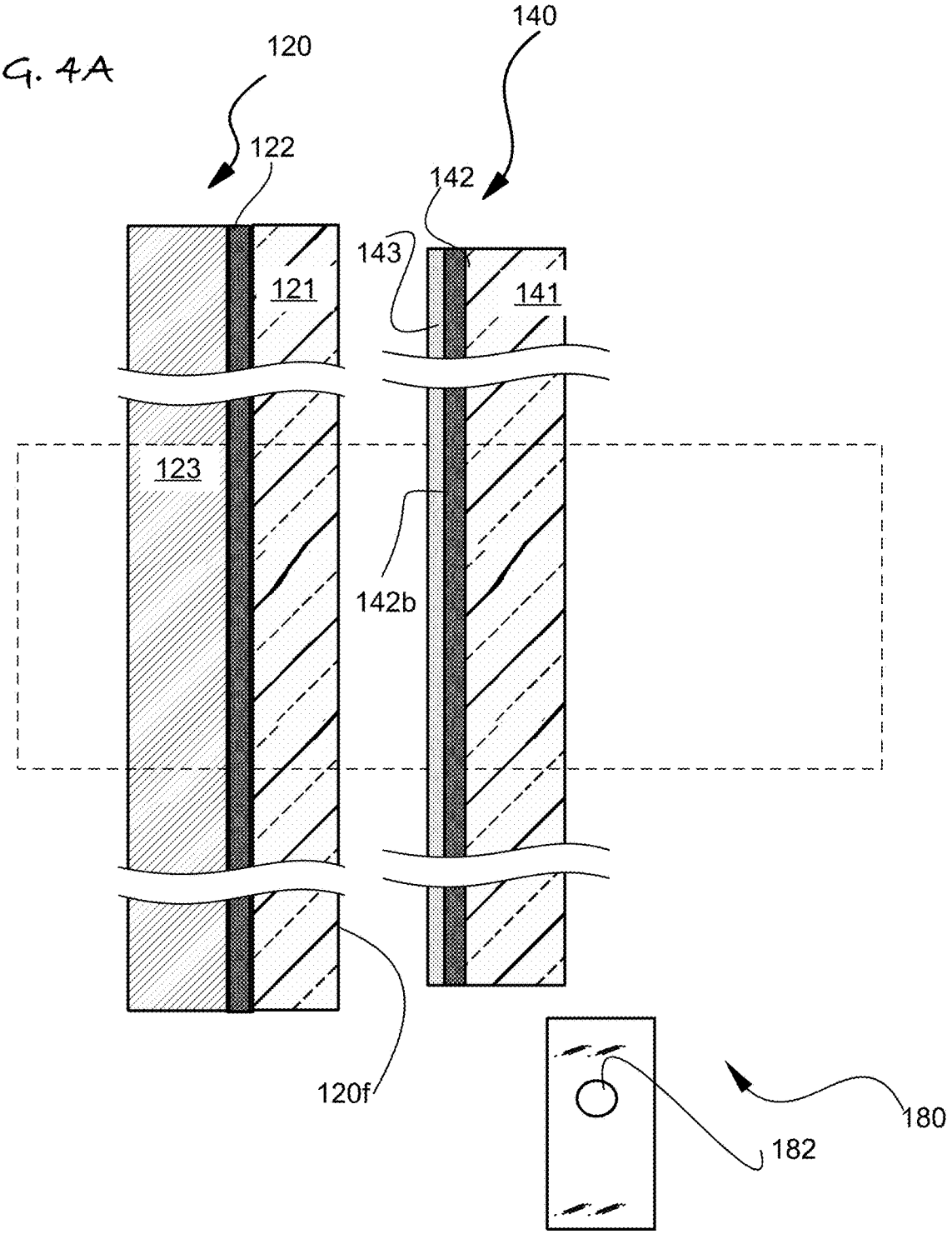
FIG. 4A is an expanded view of the portion of FIG. 2E indicated by the broken line rectangular boundary.
FIG. 4B is a plan view of an embodiment of the bottom of the container.
Figure 5:
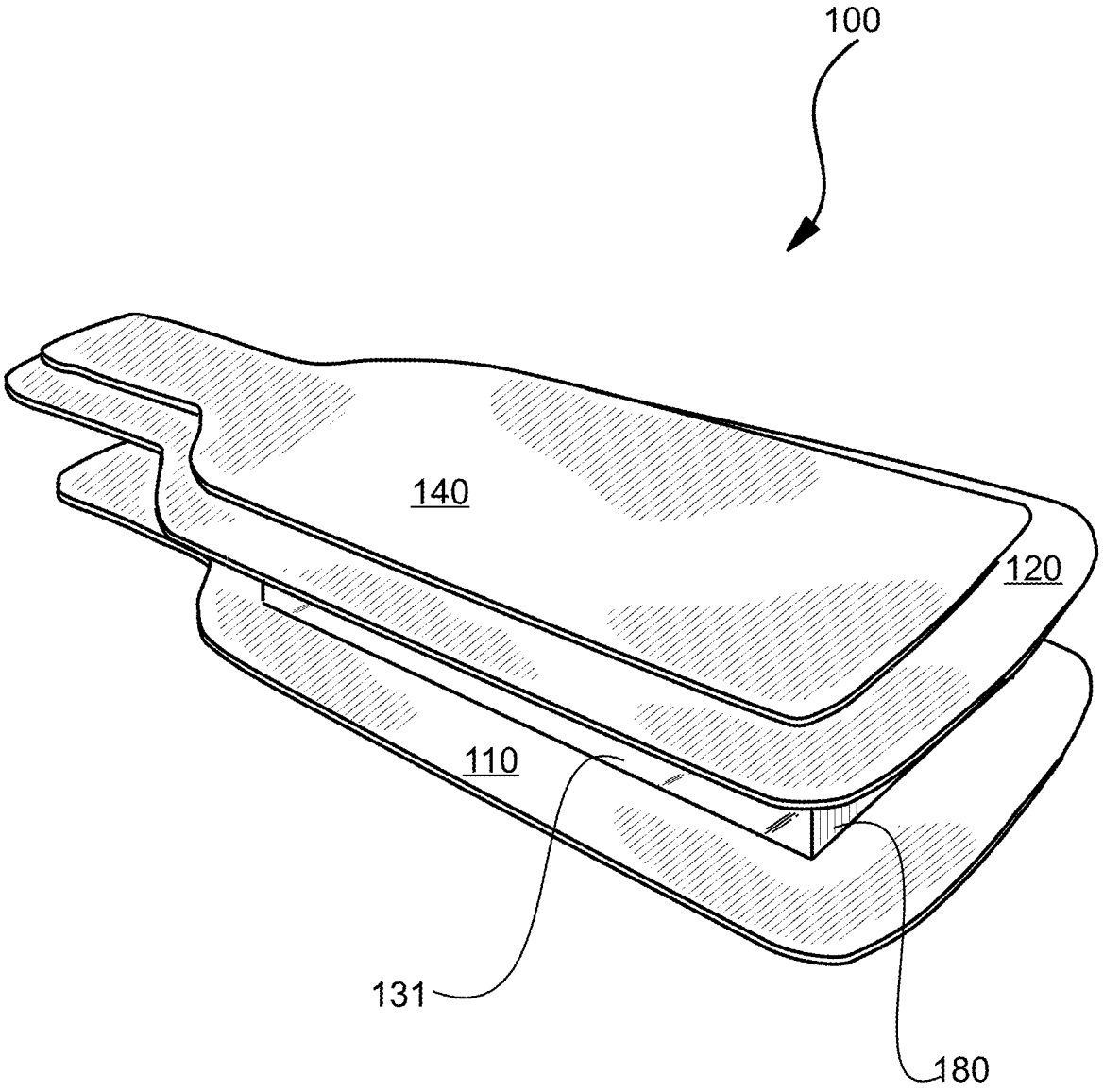
FIG. 5 is a perspective view of the first embodiment.

Since the container 100 or 130 is intended to decoratively store corks until the user is ready to transfer them to a recycler, in preferred embodiments there is a removable bottom 180 to remove corks, optionally with hole 182 for grasping, such as with a finger, as shown in FIG. 4B. Alternatively, the bottom 180 of the container is a door that is hinges but can also be fixed closed, or a solid bottom and the contents of the container are emptied out from the same area they are inserted. The hole 182 can be used to grasp the door or bottom to translate it laterally in the slot formed between the rails 125 and 126 on the side panels 131 and 132. Alternatively, the bottom 180 can translate in an orthogonal direction between rails on the rear panel 110 and the front panel 120. Other means to empty contents while attached to a wall swivel connection 162 to manually invert the container 100 or 130 so the corks therein fall out the upper opening.

FIG. 10A-11C illustrate another embodiment of the container with plaque 140 set above a spacer 190 that separates the plaque 140 from the front panel 120 to allow the lighting means 170 to be set behind the plaque 140.

The plaque 140 is preferably removable by sliding downward through a bottom slot 129.

In FIG. 11A-C, the corks are stored in a molded or preformed container 130 with cavity 101 with front face 120 having an attached spacer 190 at the sides. The spacer 190 that separates the plaque 140 from the front panel 120 to allow the lighting means 170 to be set behind the plaque 140. In FIG. 11B, the LED strip 172 edge lights a transparent panel, strip or plate 171 which is backed by a diffuse reflector 175 disposed in optical communication either the light that exits or traverses the transparent strip 171 or forms a back surface of the transparent strip to frustrate total internal reflection of light in the transparent strip, gradually illuminating a uniform portion of the plaque 140. FIG. 11C illustrate schematically alternative appearances of the container 100 by changing the plaque 140. As illustrated in FIG. 11A, the plaque 140 is preferably removable by sliding downward through a bottom slot 129 in the spacer 190.

FIGS. 11C and D illustrate alternative placements of lighting means 170 behind the plaque 140. In FIG. 11C a diffuser layer 173 faces the plaque 140 while the LED strip 172 faces the diffuser layer 173.

Figure 10B:
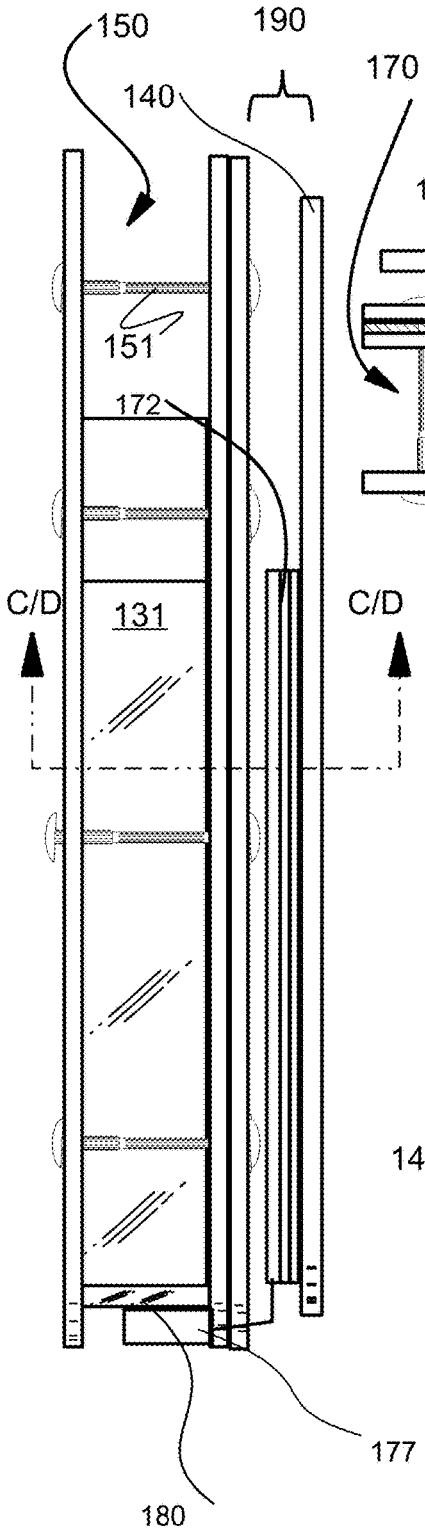
Figure 10C:
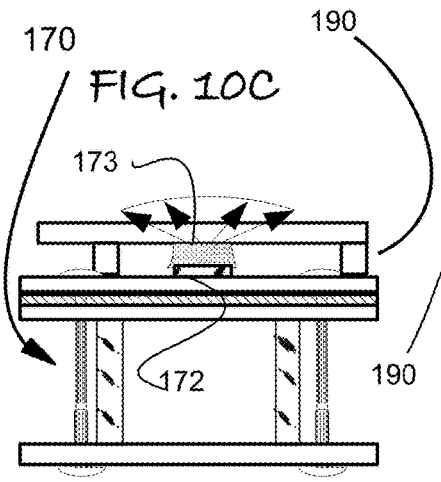
Figure 10D:
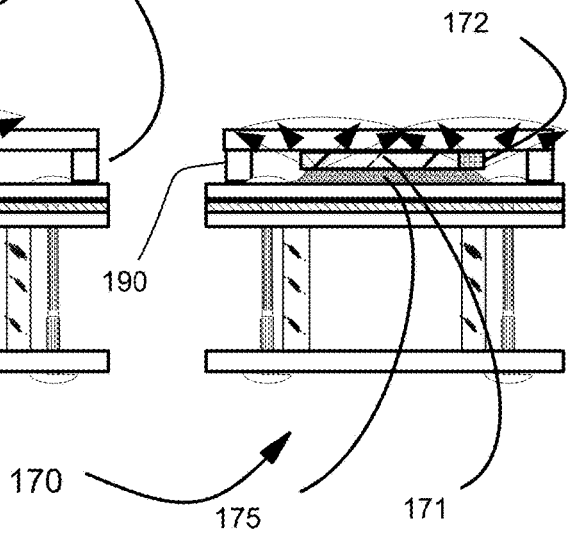
Figure 10A:
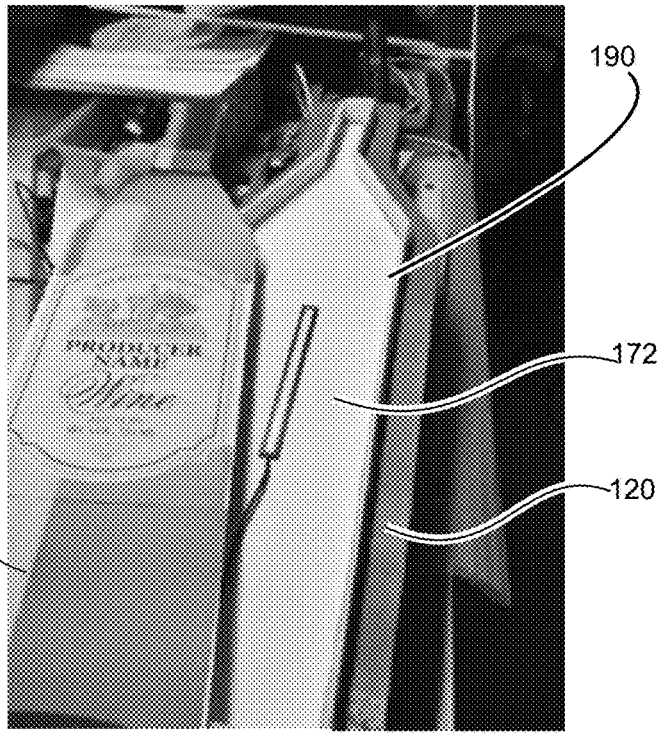

However, in FIG. 10D, the LED strip 172 edge lights a transparent which is backed by a diffuse reflector 175 disposed in optical communication either the light that exits or traverses the transparent strip 171 or forms a back surface of the transparent strip to frustrate total internal reflection of light in the transparent strip, gradually illuminating a uniform portion of the plaque 140.

Figure 12A:
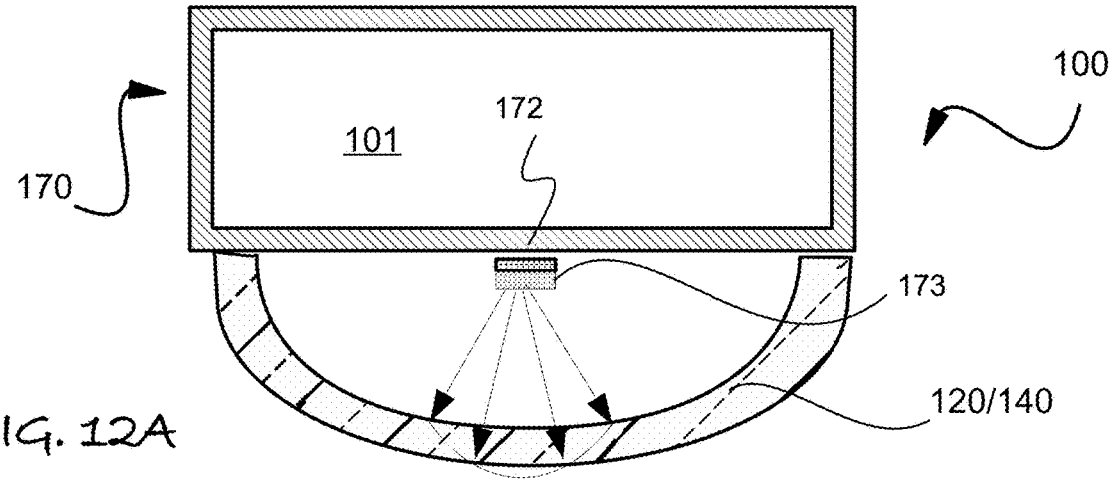
FIG. 12A-C schematically illustrate additional embodiments in cross-sectional plan views with different lighting means for a front panel.
Figure 12B:
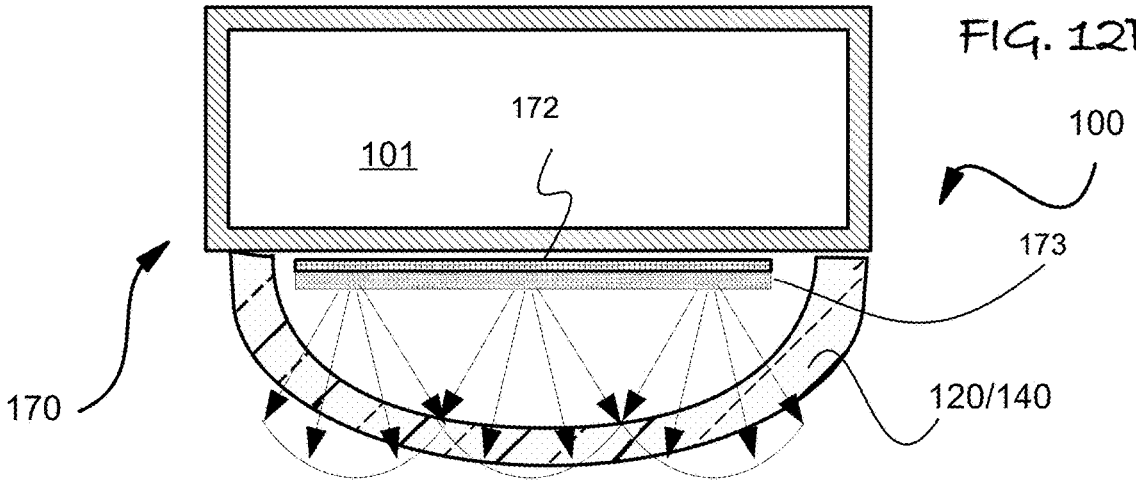
Figure 12C:
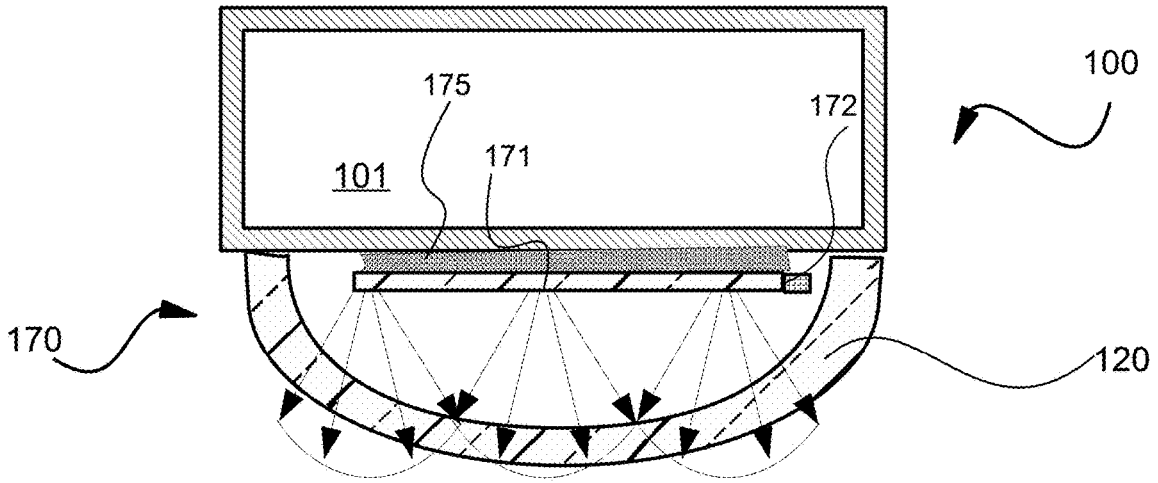

FIG. 12A-C schematically illustrate additional embodiments in cross-sectional plan views with different lighting means 170 for a curved front panel 120.

In FIG. 12A, the LED lighting strip 172 is vertically disposed behind the front panel 120 or removable plaque 140. In FIG. 12B the LED lighting strip 172 is horizontally disposed behind the front panel 120 or removable plaque 140. In FIG. 12C the LED lighting strip 172 is horizontally disposed behind the front panel 120 or removable plaque 140 and the back of the plaque 140 or front panel 120 is uniformly back lit as the LED strip 172 edge lights a transparent panel 171 which is backed by a diffuse reflector 175 disposed in optical communication to either to emit the light that exits or traverses the transparent strip 171, or forms a back surface of the transparent strip to frustrate total internal reflection of light in the transparent strip, gradually illuminating a uniform portion of the plaque 140.

Any of the embodiments may deploy any combination of multiple LED strips or of LED array panels that either edge light a transparent panel 171 with a back reflective diffuser or diffuse reflector 175 and can be used in a vertical and/or horizontal orientation. The portion of the container 100 with cavity 101 for holding the corks can be pre-molded as shown in FIG. 12A-C, among others, as well as formed by attaching together at least a rear panel 120 and side panels 131 and 132. The curved portion can form a fixed front face 120 or removable plaque 140, such as by being attached with magnets, mating slots that receive pins or detents, as well as hook and loop fasteners, and the like. A molded or assemble vessel or container to provide cavity 101 can have any cross-sectional shape, such as round, rectangular, curvilinear and the like.

Figure 13B:
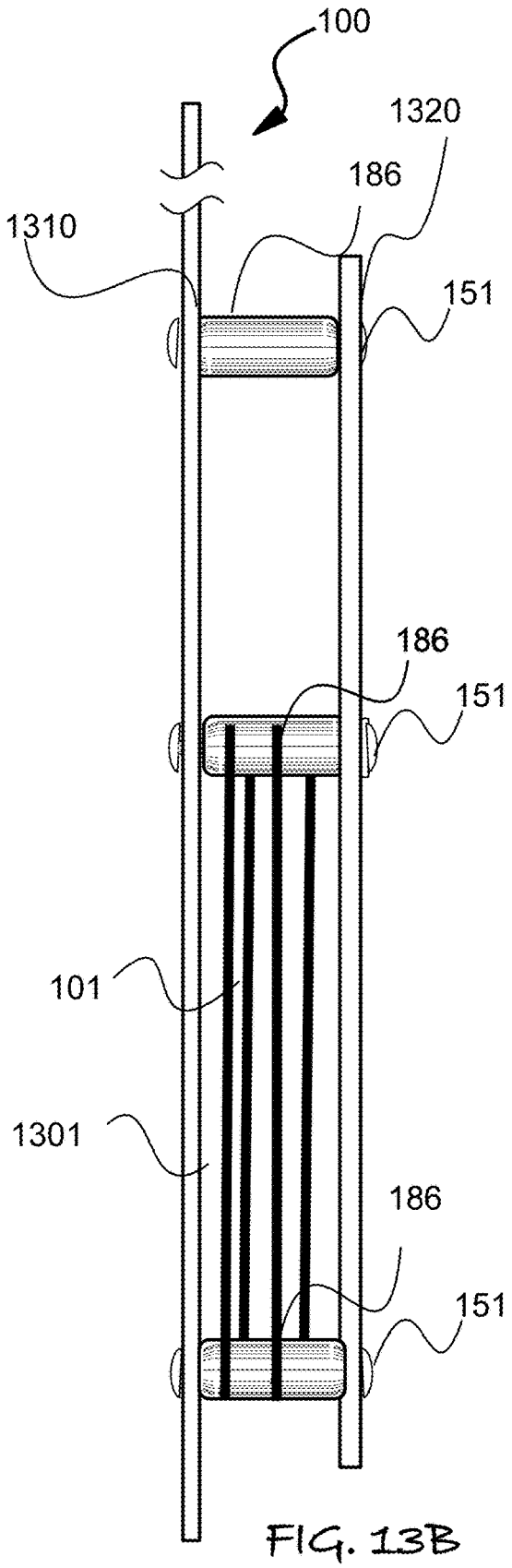
FIGS. 13A and 13B are side elevation views of additional embodiments of the innovations.
Figure 13A:
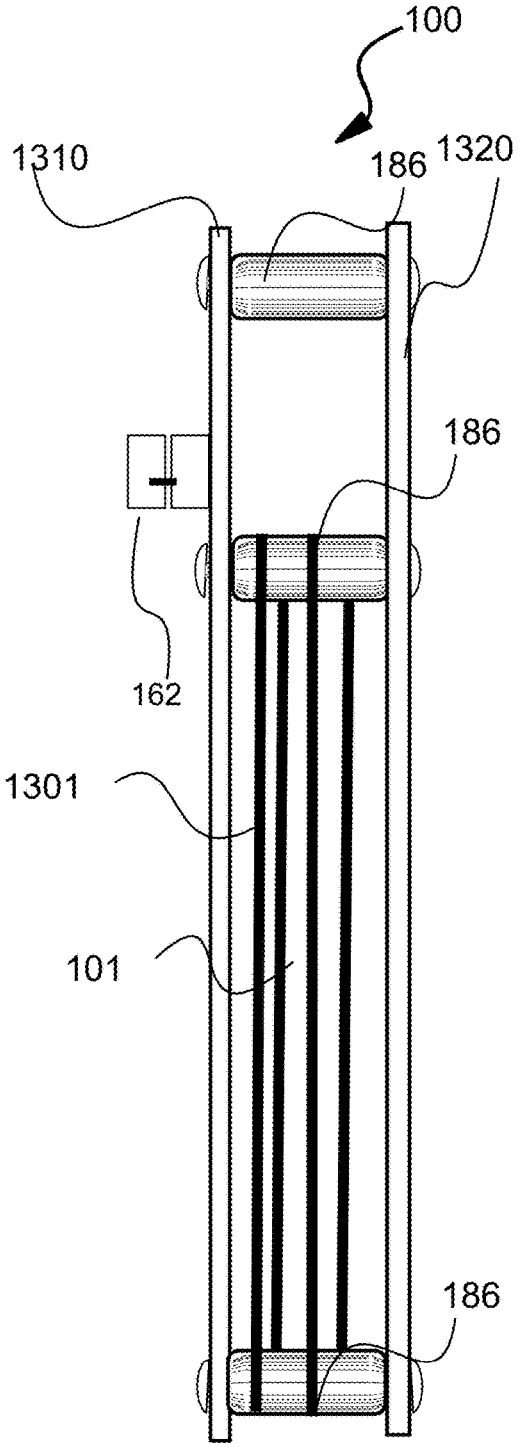

FIGS. 13A and 13B are side elevation views of additional embodiments of the innovations in which the container 101 has a cavity 101 between a face plate 1320 and backing plate 1310. Corks 186 with an interior bolt assembly 151 space apart the faceplate 1320 from the backing plate 1310. The lateral sides of the cavity 101 are formed by a strap, wire, or twine 1301 that extends by multiple wraps from the top left cork, around the bottom corks 186 and then up to the top right cork 186 before an adjacent raps in the opposite direction, continuing to span the width of the corks 186 to at least space the segments of the strap 1301 closer than the diameter of the corks 186. The strap 1301 is preferably a wide leather strip that is knotted or otherwise adhered or bonded to the corks upper right and left corks 186.

In FIG. 13A the front plate 1320 and backing plate 1310 can be the same size with a swivel connector 162 extending outward from the rear surface 1310*b* of the backing plate.

Figure 14:
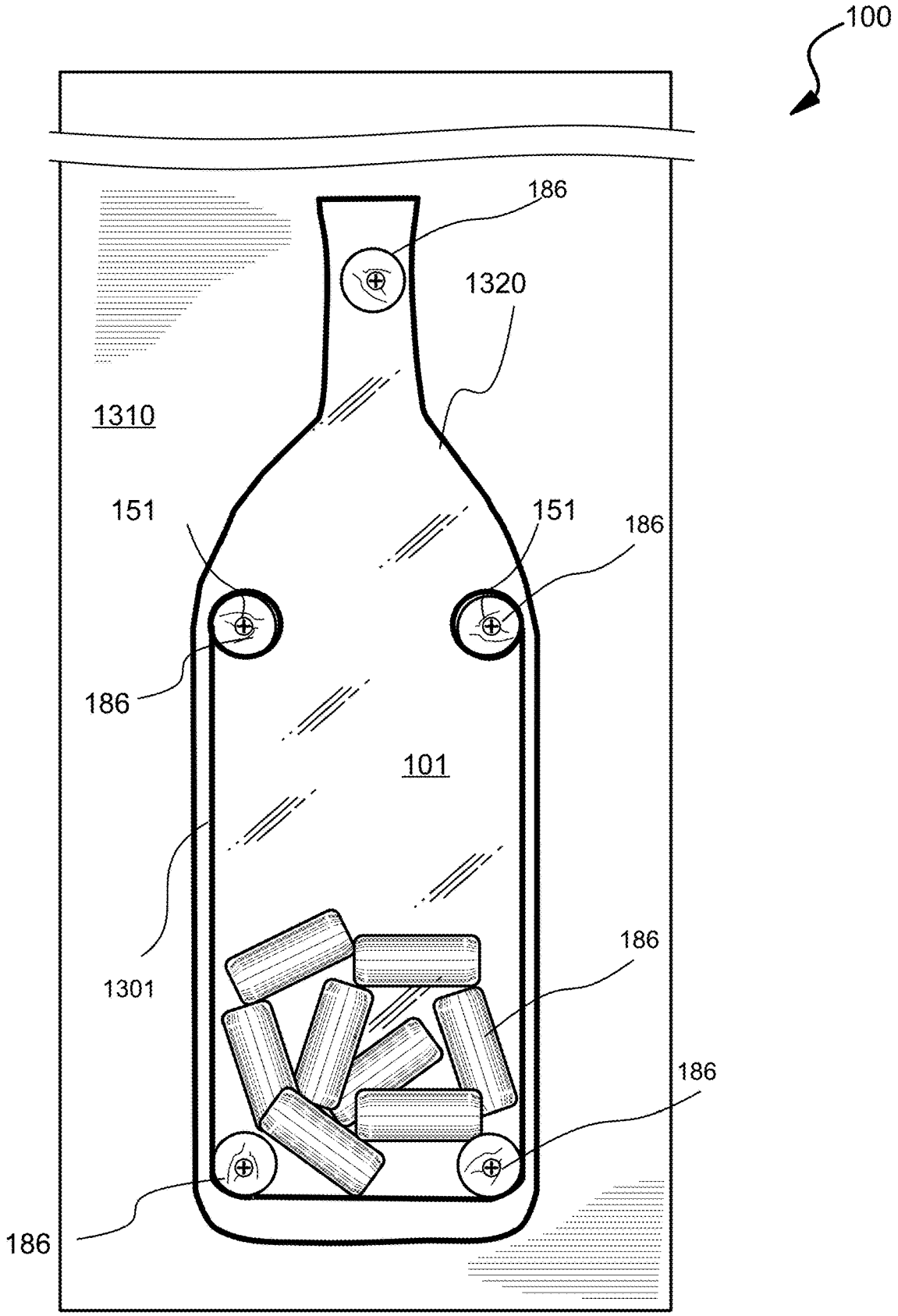
FIG. 14 is front elevation view of the embodiment of FIG. 13B in which corks are visible through the front of the container.

In FIG. 13A the backing plate 1310 is considerably larger than the front plate, while in the embodiment of FIGS. 13B and 14 the front plat 1320 is shaped like a wine bottle and is optionally transparent as illustrated to display the corks 186 in the cavity 101.

The corks 186 that act as spacers in the various embodiment help reinforce and reminder wine consumers or server that the used corks from the bottles opened should be placed in the various forms of the cavity 101 to be recycled. The wine bottle shape of the front panel or face in the various embodiments also reinforces and reminds the consumer or servers to recycle the corks.

While the innovations has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A container comprising:

a. a planar back panel, b. a front panel having at least a portion of a perimeter that is planar and spaced apart from and parallel to the planar back panel, c. a pair of side panels, each side panel spaced apart from the other side panel and having opposing edges coupled to the planar back panel and planar portions of the front panel to form an enclosed volume with an upper rim in which each spaced apart side panel of the pair is disposed orthogonal to both the planar back panel and the front panel, d. in which the front panel is a lamination of a clear front sheet having printing on a back surface facing toward the planar back panel and a rear sheet covering the printing on the back surface of the clear front sheet.

2. The container of claim 1 further comprising a plaque removably coupled to the front panel.

3. The container of claim 2 in which the plaque is removably coupled in a spaced apart relationship from the front panel by a magnetic means.

4. The container of claim 2 in which the plaque and the front panel are one of printed and decorated on an internal surface that faces a transparent layer that is one of the front of the plaque and an outward face of the front panel.

5. The container of claim 1 further comprising a mean to back light at least a portion of the front panel.

6. The container of claim 1 in which the front panel has one of a perimeter shaped in the manner of a beverage container and a central portion that projects outward as a half section of a generally cylindrical bottle.

7. A container comprising:

a. a planar back panel, b. a front panel having at least a portion of a perimeter that is planar and spaced apart from and parallel to the planar back panel, c. a pair of side panels, each side panel spaced apart from the other side panel and having opposing edges coupled to the planar back panel and planar portions of the front panel to form an enclosed volume with an upper rim in which each spaced apart side panel of the pair is disposed orthogonal to both the planar back panel and the front panel, d. a plaque removably coupled to the front panel in which the plaque is removably coupled in a spaced apart relationship from the front panel by a magnetic means.

8. The container of claim 7 in which the plaque and the front panel are one of printed and decorated on an internal surface that faces a clear layer that is one of the front of the plaque and an outward face of the front panel.

9. The container of claim 7 further comprising a mean to back light at least a portion of the front panel.

10. The container of claim 7 in which the front panel has one of a perimeter shaped in the manner of a beverage container and a central portion that projects outward as a half section of a generally cylindrical bottle.

* * * * *